US009775425B2

(12) United States Patent
Bruffey

(10) Patent No.: US 9,775,425 B2
(45) Date of Patent: Oct. 3, 2017

(54) BACKPACK WITH STABILIZING HANDLES

(71) Applicant: Schools Insurance Program for Employees, Atascadero, CA (US)

(72) Inventor: Mike Bruffey, Atascadero, CA (US)

(73) Assignee: Schools Insurance Program for Employees, Atascadero, CA (US)

( * ) Notice: Subject to any disclaimer, the term of this patent is extended or adjusted under 35 U.S.C. 154(b) by 33 days.

(21) Appl. No.: 14/872,892

(22) Filed: Oct. 1, 2015

(65) Prior Publication Data

US 2016/0095417 A1 Apr. 7, 2016

Related U.S. Application Data

(60) Provisional application No. 62/058,250, filed on Oct. 1, 2014.

(51) Int. Cl.
*A45F 3/04* (2006.01)
*A45C 13/30* (2006.01)

(52) U.S. Cl.
CPC ..... *A45F 3/04* (2013.01); *A45C 13/30* (2013.01)

(58) Field of Classification Search
CPC .. A45F 3/04; A45F 3/042; A45F 3/047; A45F 5/00; A45F 2003/045; A45C 13/30; A61G 1/044
See application file for complete search history.

(56) References Cited

U.S. PATENT DOCUMENTS

| | | | | |
|---|---|---|---|---|
| 1,749,999 | A | 3/1930 | Crocker | |
| 3,899,109 | A | 8/1975 | Noice | |
| 4,840,144 | A | 6/1989 | Voorhees et al. | |
| 4,981,110 | A | 1/1991 | Llewellyn | |
| 6,122,778 | A * | 9/2000 | Cohen | A41D 13/0007 182/3 |
| 6,305,587 | B1 | 10/2001 | Miller | |
| 7,341,025 | B1 * | 3/2008 | Streeter | A47D 13/046 119/770 |
| 7,945,975 | B2 * | 5/2011 | Thomas | A61G 7/1023 182/3 |

(Continued)

OTHER PUBLICATIONS

Eddie Bauer, Sport Backpack Harness, http://www.target.com/p/eddie-bauer-sport-backpack-harness/-/A-14955109, last accessed May 22, 2014.

(Continued)

*Primary Examiner* — Corey Skurdal
(74) *Attorney, Agent, or Firm* — SoCal IP Law Group LLP; Guy Cumberbatch

(57) ABSTRACT

Disclosed is a backpack having a plurality of stabilizing handles. The handles are of fixed dimension and are distributed around the outside of a main compartment of the backpack to provide a number of places for a caregiver to grip when assisting a wearer of the backpack walk. A rear side of the main compartment may have a four handles, a front side of the backpack may have 6 handles, and side panels of the backpack may have 4 handles. A lead may optionally be attached to the D-ring on the rear side of the backpack. Providing numerous grip handles around the backpack enhances the ability of the caregiver to provide spotting support, without stigmatizing the user from the use of a harness or other such assistive device.

20 Claims, 8 Drawing Sheets

(c) 2016 Schools Insurance Program for Employees

(56) References Cited

U.S. PATENT DOCUMENTS

| | | | | |
|---|---|---|---|---|
| 8,066,161 | B2 * | 11/2011 | Green | A41D 13/0007 224/157 |
| 8,147,252 | B1 | 4/2012 | Stanford et al. | |
| 8,336,503 | B2 | 12/2012 | Spinelli | |
| 8,627,514 | B1 * | 1/2014 | Scoggins | B60R 7/14 2/102 |
| 2008/0078335 | A1 | 4/2008 | Bush et al. | |
| 2010/0005593 | A1 * | 1/2010 | Bowling | A61G 1/013 5/627 |
| 2011/0204114 | A1 * | 8/2011 | Miller | A45F 3/06 224/582 |
| 2014/0263519 | A1 * | 9/2014 | Saucedo | A45F 3/08 224/633 |

OTHER PUBLICATIONS

Brica, By-My-Side Safety Harness Backpack, http://www.amazon.com/BRICA-By-My-Side-Safety-Harness-Backpack, last accessed May 12, 2014.

Mobile Edge, Premium Laptop Backpack, http://www.ebags.com/product/mobile-edge/premium-backpack/18155, last accessed May 12, 2014.

Eagle Creek Grand Voyage, 90L Travel Pack, http://www.backcountry.com/eagle-creek-grand-voyage-901-tavel-pack, last accessed May 12, 2014.

Ruggard Triumph, 35 Sling Bag, http://www.bhphotovideo.com/c/product/878261-REG/ruggard_pgb, last accessed May 12, 2014.

* cited by examiner (c) 2015 Schools Insurance Program for Employees (c) 2015 Schools Insurance Program for Employees (c) 2015 Schools Insurance Program for Employees (c) 2015 Schools Insurance Program for Employees (c) 2015 Schools Insurance Program for Employees (c) 2015 Schools Insurance Program for Employees (c) 2015 Schools Insurance Program for Employees (c) 2015 Schools Insurance Program for Employees

BACKPACK WITH STABILIZING HANDLES

RELATED APPLICATION INFORMATION

This patent claims priority from provisional patent application No. 62/058,250 filed Oct. 1, 2014, titled BACKPACK WITH STABILIZING HANDLES.

FIELD OF THE INVENTION

The present application relates to a backpack to be worn by a person and, in particular, to a stabilizing backpack typically worn by children who have trouble with balance.

BACKGROUND OF THE INVENTION

There are a myriad of products intended to protect young children from the everyday dangers as the child grows and explores their new world. Car seats protect them from physical harm while riding in a car and sunshades shield their eyes and skin from the harmful effects of ultraviolet light. High chairs secure them at the dinner table, and barriers keep them from falling down stairs and out of beds. As toddlers begins to walk, climb, and explore, the risk of injury from falling and wondering off also increases.

Parents and care providers typically attempt to assist the toddler with these activities and protect them from the inherent dangers of growing up and various attempts have been made in the past to provide a safety and support harness for children. Other solutions include the use of a baby walker, safety vest, or similar garments. These solutions can limit the toddler's sense of independence and can impede the natural development of balance and strength. Harnesses which only secure to a child in limited areas can lead to the toddler escaping and elongated support straps and handles can create hazards if not constantly controlled by the caregiver.

Not just toddlers but older children with balance and gait issues have a need for assistance in this manner. Abnormal gaits in children include a stepping gait often arising from peripheral neuropathies, spina bifida and polio, a spastic gait associated diplegic and quadriplegic cerebral palsy, and 'clumsy gait' which is a term used when there are problems with motor co-ordination, occurring with mild cerebral palsy, cerebellar ataxia, lower motor neuron disorders, inflammatory arthritis or myopathies. Physical and Occupational Therapists as well as families with a disabled child desire a simple device that can be used to assist them in assisting those in their care to walk. In the past trainers have mainly used their hands to hold the trainee around the waist or torso, but this involves bending over or stooping which places the trainer in a weakened position and prone to injury. Some trainers use various types of infant walkers, which may reduce the load they need to support but provides little other assistance. Many harnesses have been devised by others not only for such therapeutic purposes but also for teaching such recreational abilities as skiing and skating. Full body harnesses exist in the marketplace for various purposes such as rock climbing and hang gliding, but these are not well suited to everyday moving about.

Attempts to address these problems have existed for many years, including the following U.S. patents and publications: U.S. Pat. Nos. 1,749,999; 1,193,374; 4,537,154; 4,840,144; 4,981,110; 5,435,272; 6,125,792; 6,338,699; 6,968,809; 7,267,080; 7,341,025; 8,147,252; 8,336,503; 2008/0078335.

Most solutions provide harnesses, typically with a large handle at the top or in the back, while some also have leads, legs straps or crotch straps.

While these devices fulfill their particular objectives, each suffers from one or more disadvantages, most notably the attendant stigma or indignity associated with wearing a device that is clearly intended as a walking aid.

SUMMARY OF THE INVENTION

The present application discloses a backpack having a plurality of stabilizing handles. The handles are of fixed dimension and are distributed around the outside of a main compartment of the backpack to provide a number of places for a caregiver to grip when assisting a wearer of the backpack walk. A rear side of the main compartment may have a four handles, a front side of the backpack may have 6 handles, and side panels of the backpack may have 4 handles. An adjustable length lead is attached to a D-ring at the top of handle (40). A lead may optionally be attached to the same D-ring on the rear side of the backpack. Providing numerous grip handles around the backpack enhances the ability of the caregiver to provide spotting support, without stigmatizing the user from the use of a harness or other such assistive device.

DESCRIPTION OF THE PREFERRED EMBODIMENTS

Figure 1:
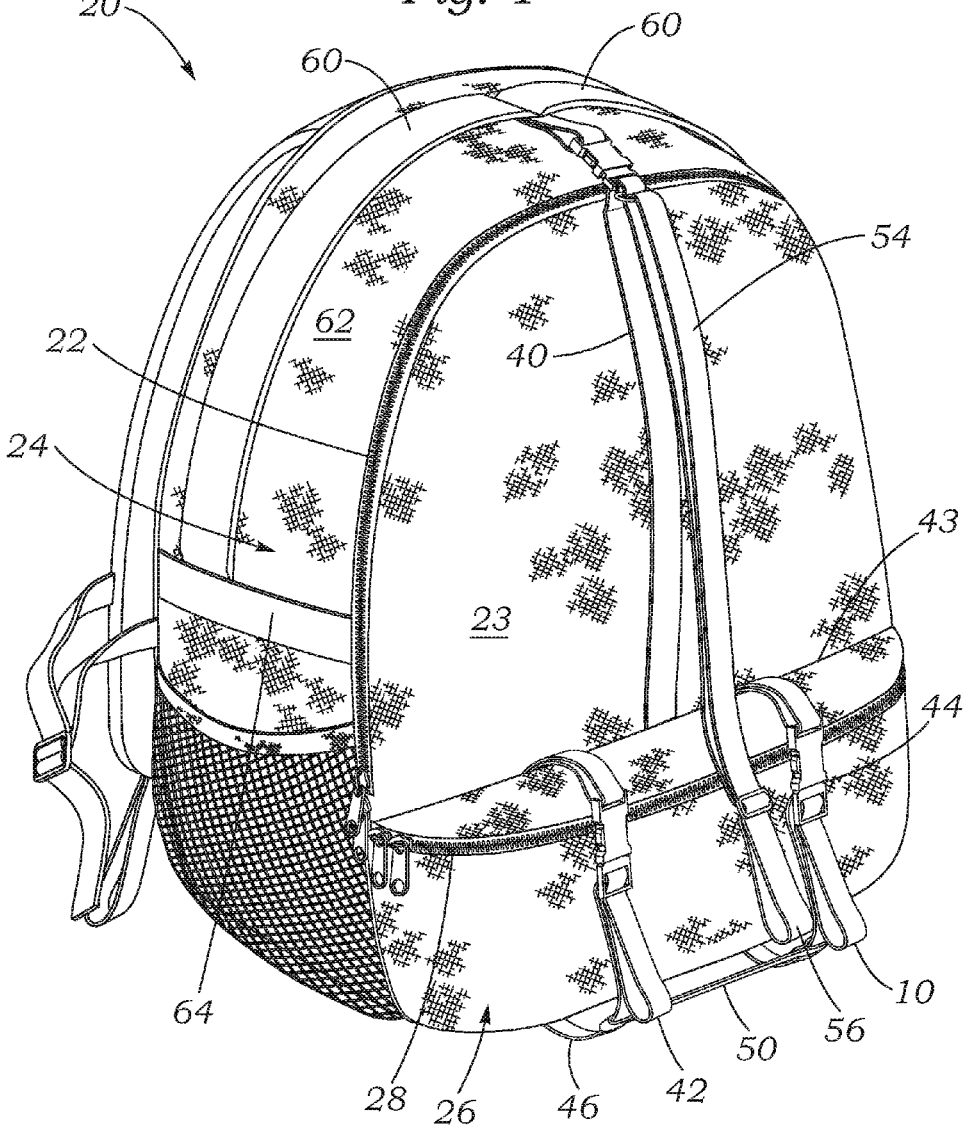
FIG. 1 is a perspective view of a rear face of an exemplary stabilizing backpack of the present application illustrating a number of handles which can be grasped by caregivers.

The present application provides a backpack having a plurality of stabilizing handles thereon. For the purpose of the present application, a "handle" is different than a more generic strap of a backpack, in the sense that a "handle" defines a fixed loop of material. That is, although a number of the stabilizing handles described herein may be made of strap material, the fact that they define a fixed loop having a constant loop dimension distinguishes them from straps in general. Everyone understands that backpacks often have a number of different straps, most of which are adjustable. A "handle" in the context of the present invention is not adjustable. That is not to say that the backpack described herein cannot have adjustable straps, which can also be grasped by a caregiver to stabilize the wearer of the backpack, but these are not strictly "handles" as defined herein.

Fabrics for backpacks are numerous, and the present application covers any variety. For example, the oldest backpacks were cotton canvas waterproofed with a heavy wax coating. Most modern backpacks are a combination of synthetic materials to improve the strength and water resistance of the canvas fabric. For example, many backpacks are made of Polyurethane coated Cordura® Nylon, Kodra Nylon, or other Nylon fabrics. Furthermore, leather or other reinforcing material can be added as panels to backpacks, and of course certain components of backpacks include cushioning material, such as polyester fill, or reinforcing panels and the like. The present application is intended to cover backpacks of all types and materials. The handles described above may be formed by any of the components of the backpack, as long as the handle has a fixed size, as mentioned. For example, dangling nylon straps can be sewn into loops to form the handles, or a single nylon strap can be sewn on either end to a cushioned shoulder strap so as to form a loop. Those of skill in the art will understand that fixed loops of flexible material can be formed in a variety of ways.

The handles described herein are intended to be grasped by caregivers of the wearer of the backpack, which caregivers are typically full-grown adults. Therefore, the dimension of the fixed loop handles must be at least as large as the average palm of an adult; the conventional manner of grasping a loop-type handle being to stick the four fingers through the loop with the thumb outside. Consequently, the dimensions of an oval-shaped fixed loop handle should be at least 4 inches in a long dimension and 0.75 inches across, and more particularly between about 4-6 inches in the long dimension and between about 0.75-1.5 inches across.

An important aspect of the present application is the sheer number of handles provided around the stabilizing backpack. In a preferred embodiment, the stabilizing backpack of the present application has at least 9 handles distributed around the front, back, top, and sides. In this way, a caregiver can easily grasp one of the multiple handles if necessary to prevent the wearer of the backpack from falling. Optionally, a lead may be attached to the D-ring on the rear of the backpack to provide a means to maintain continual contact with the backpack without necessarily affecting the balance of the wearer. In a particularly preferable embodiment, the stabilizing backpack has 2 large upper handles on either lateral side, at least 3 handles on the rear face of the backpack, and at least 4 handles on the front face of the backpack. The directions front and rear are relative to the wearer when the backpack is on his or her back.

Figure 2:
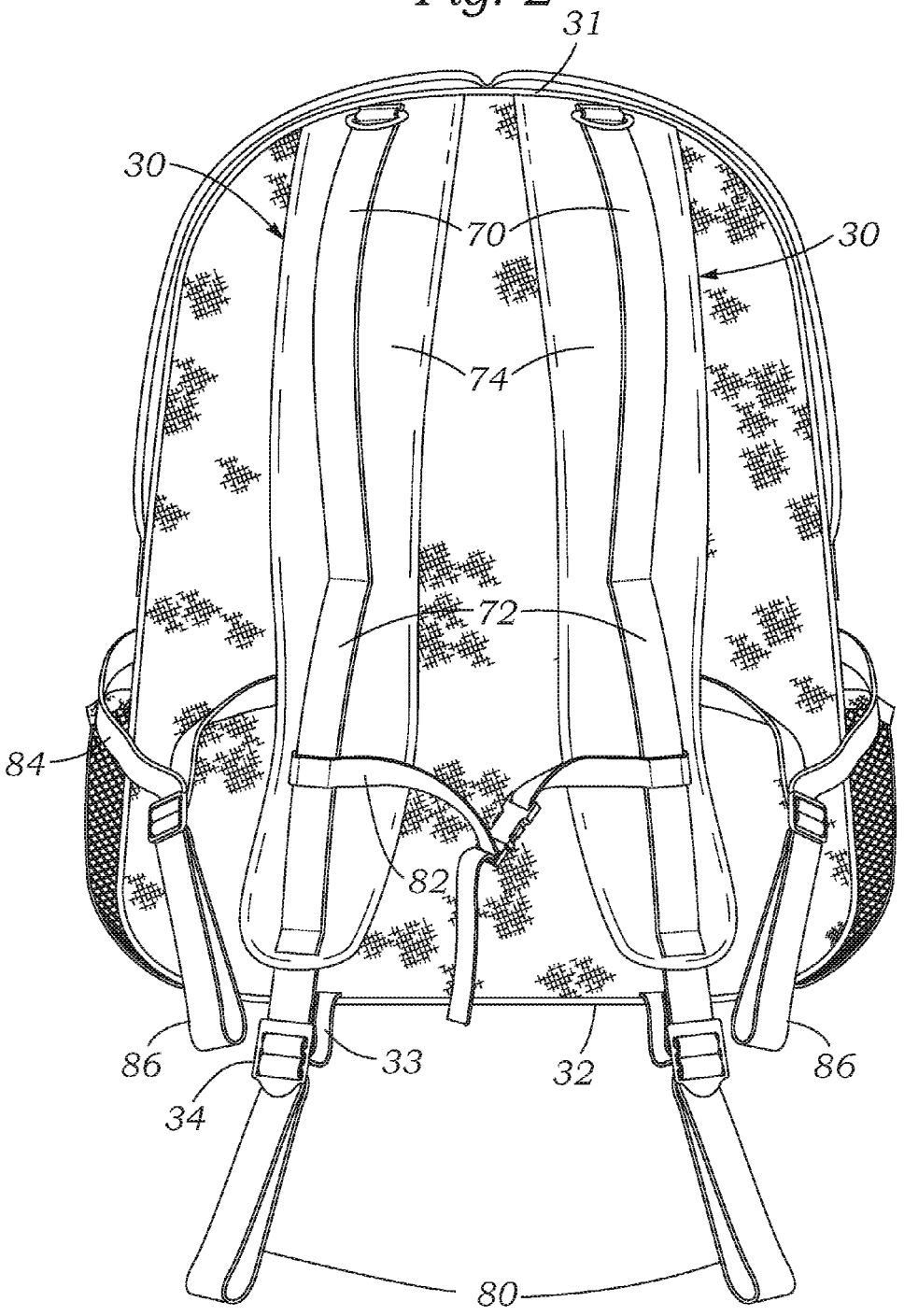
FIG. 2 is a front elevational view of the stabilizing backpack illustrating a number of handles which can be grasped by caregivers.

FIG. 1 is a perspective view of a rear face and FIG. 2 is a front elevational view of an exemplary stabilizing backpack 20 of the present application illustrating a number of handles which can be grasped by caregiver. The rear view illustrates a primary zipper 22 surrounding a rear panel 23 that is used to provide access to an inner cavity (not shown) of a main compartment 24 of the backpack 20. The zipper 22 typically extends from one lower side up around the top rear corner of the main compartment 24 to another lower side. A pouch 26 is provided on the lower rear side of the backpack accessed by a secondary zipper 28.

The front face of the backpack 20 includes a pair of shoulder straps 30, which are typically padded with some type of filler. The shoulder straps 30 are sewn at an upper end to two laterally spaced apart locations on an upper front corner 31 of the main compartment 24. Lower ends of the shoulder straps 30 are secured to a lower front corner 32 of the main compartment 24 using flexible straps 33 that pass through an adjustable buckle 34.

Up to now, the basic structural components of the backpack has been described, and are fairly conventional. Of course, the present concept of multiple stabilizing handles can be applied to any type of backpack available. The provision of the plurality of handles on a backpack are intended to provide the wearer with some sort of camouflage as to the function of the handles, or in general conceal the stabilizing nature of the backpack. Ordinary backpacks often have a couple handles, such as at the top center, and sometimes straps that resemble handles, so the present backpack blends in quite easily. However, the professional trained at chaperoning individuals prone to falling or otherwise losing their balance will recognize the enhanced safety features incorporated into this design.

Figure 3:
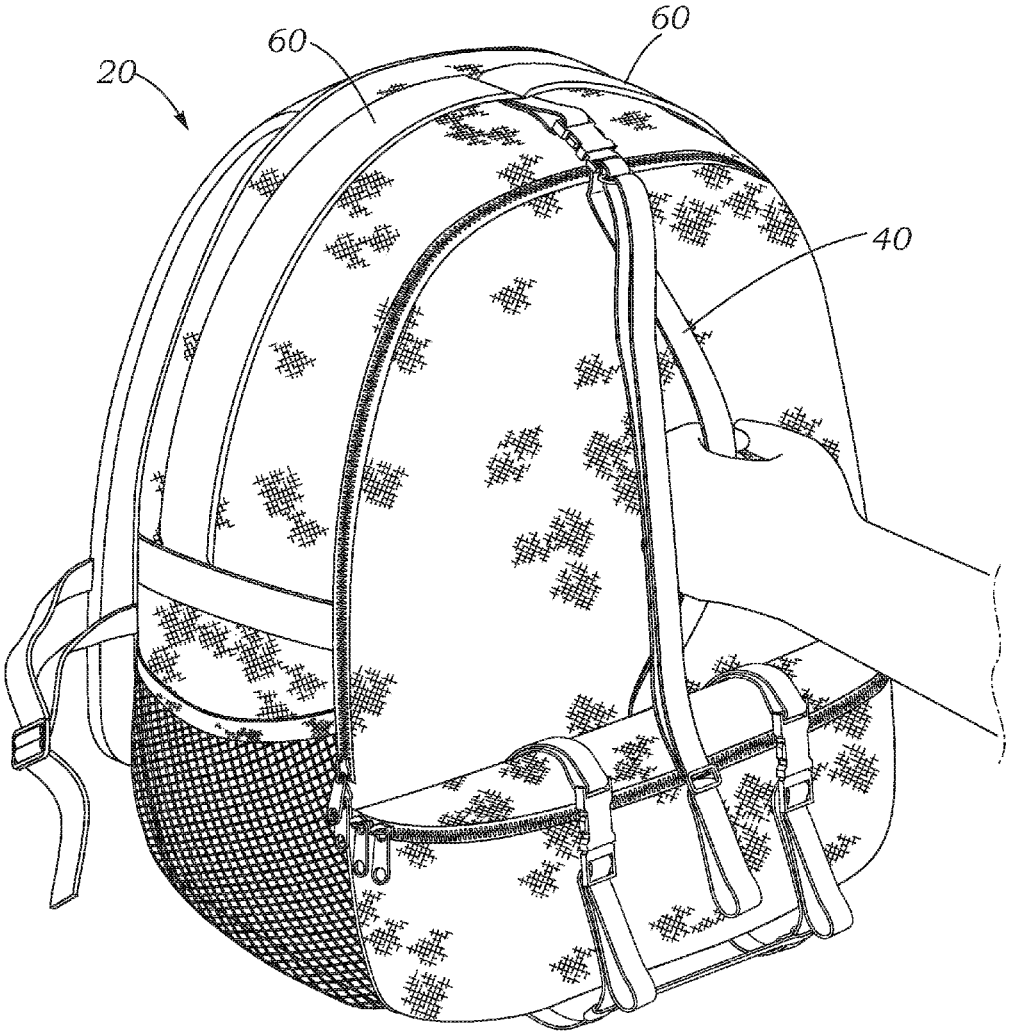
FIG. 3 is a perspective view of the rear of the stabilizing backpack showing how a caregiver grasps the rear central handle.
Figure 5:
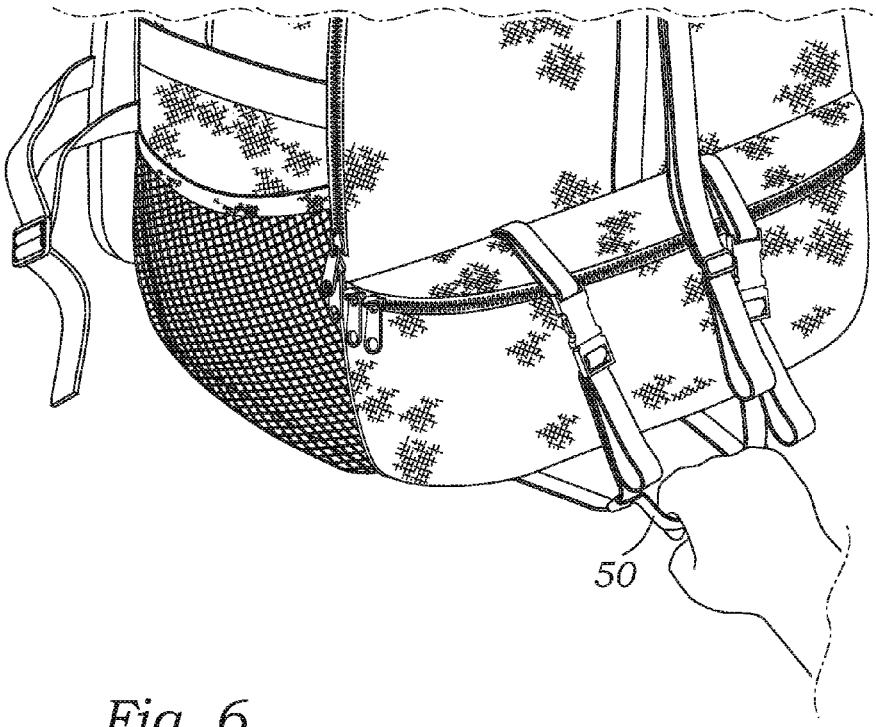
FIGS. 5 and 6 are partial rear perspective views of the stabilizing backpack showing how a caregiver grasps several lower rear handles.
Figure 6:
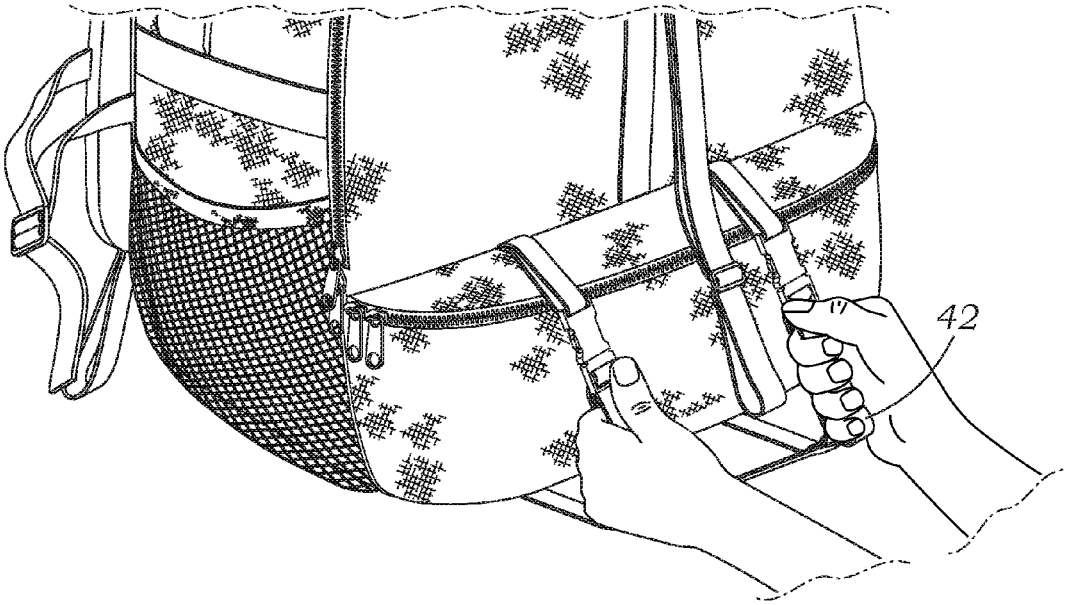

With reference again to FIG. 1, the rear face of the backpack 20 includes a central vertical handle 40 formed by a strap that is secured both at the top and bottom of the rear panel 23. FIG. 3 is a perspective view of the rear of the stabilizing backpack showing how a caregiver grasps the rear central vertical handle 40. A pair of lower rear handles 42 are provided by loops of strap material eventually secured to a horizontal seam 43 at the junction between the rear panel 23 and the pouch 26. These two rear handles 42 are laterally spaced from one another so as to be respectively toward the left and right sides of the rear of the backpack 20, and maybe detachable through the use of strap buckles 44. Preferably, a reinforcing strap 46 extends downward from the upper end of each of the rear handles 42 and is secured to a bottom panel (not shown) of the backpack 20, as best seen in FIG. 5. Another lower rear handle 50 is provided by a strap of material sewn between the two vertical reinforcing straps 46. FIGS. 5 and 6 show how a caregiver grasps the central rear handle 50 and the two lateral rear handles 42.

Figure 4:
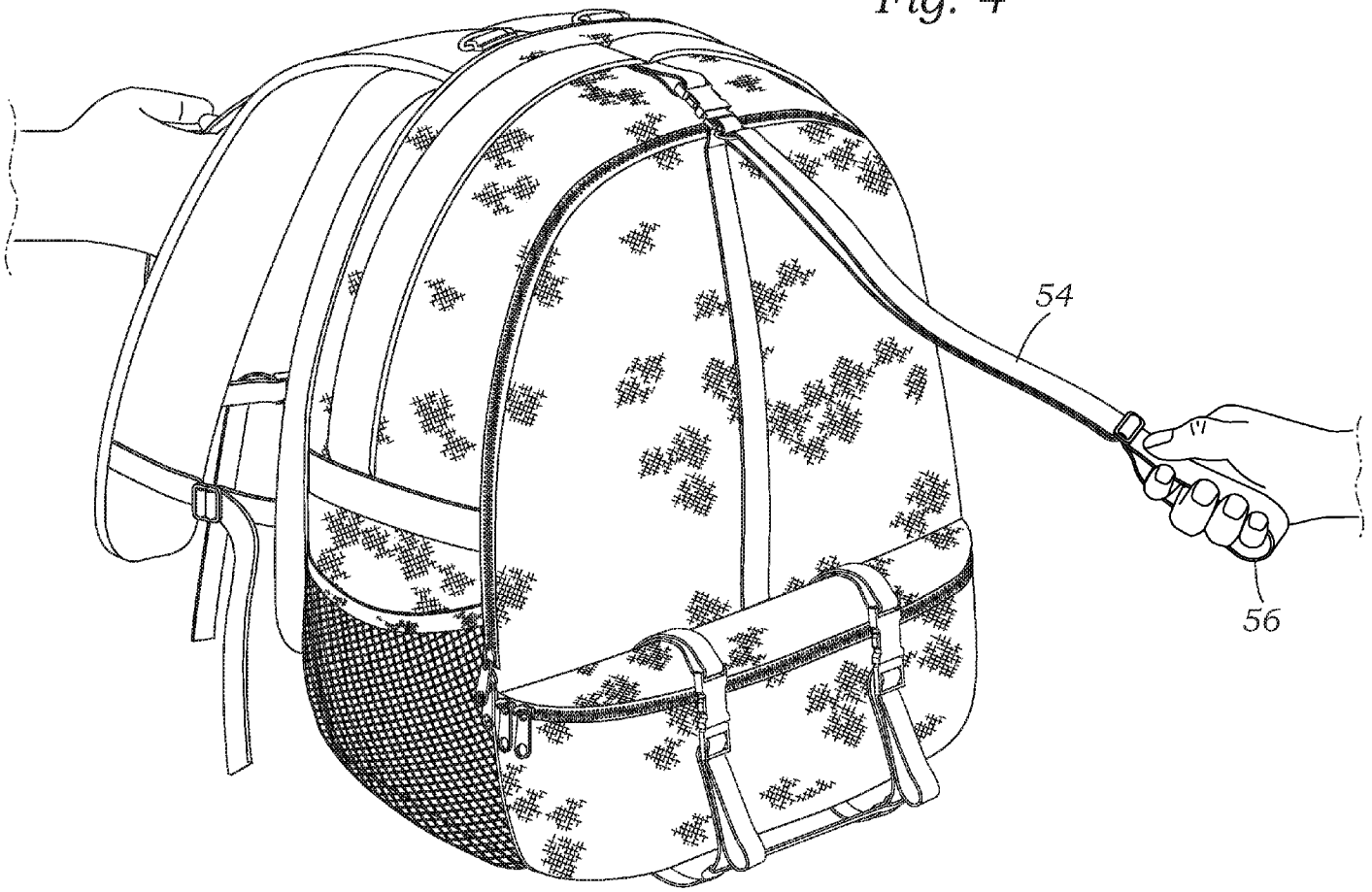
FIG. 4 is another rear perspective view of the stabilizing backpack showing how a caregiver grasps the rear adjustable length lead, as well as a front handle attached to one of the shoulder straps of the backpack.

An adjustable rear lead 54 terminating in a lead handle 56 is affixed to a D-ring at the top of the backpack 20. As mentioned above, the provision of a lead 54 is optional because it may defeat the purpose of concealing the stabilizing nature of the backpack 22 the untrained eye. However, the backpack 20 is particularly useful for very small children who are just learning to walk or may also have gait problems, and attaching an even longer lead than is shown for such children is a fairly common sight. FIG. 4 shows how a caregiver grasps the affixed rear lead handle 56.

To summarize, the rear of the backpack 20 has the central vertical handle 40, the two lower lateral handles 42, the lower central horizontal handle 50, and the lead 54 with its handle 56, for a total of 5 handles on the rear. It should be understood that even more handles could be added to the various sides of the backpack, although the practical maximum occurs when the handles interfere with each other.

Figure 7:
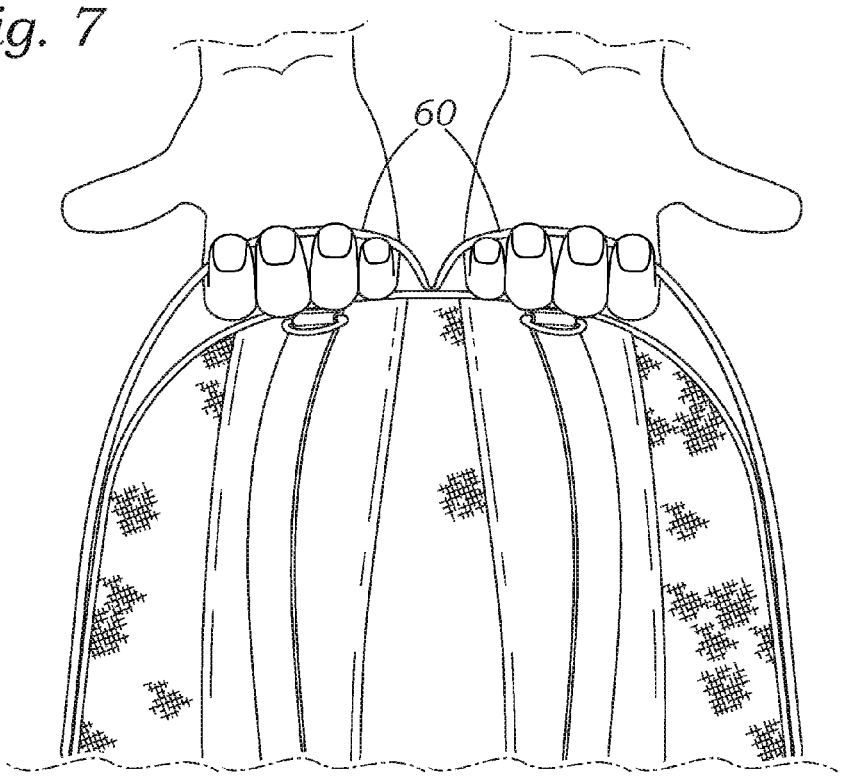
FIGS. 7 and 8 are partial front perspective views showing how a caregiver grasps several upper front and top handles.

With reference again to FIG. 1, the backpack 20 has two upper handles 60 that are associated with the left and right sides. Each handle 60 is secured to a top area of a central panel 62 forming the roof of the main compartment 24. The lower end of each handle 60 attaches to a midpoint of the central panel 62 on the left and right sides of the backpack. The two upper handles 60 are preferably made of reinforced straps, such as a double layer of strap material sewn together. These handles are intended to be the primary grasping points for the caregiver, as the wearer of the backpack is often shorter than the caregiver and they will typically be walking side by side. FIG. 7 shows how a caregiver grasps primary upper handles 60. In addition to the upper handles 60, a pair of side handles 64 are provided on the left and right sides of the main compartment 24. These side handles 64 are preferably formed of horizontal straps of material sewn on either end at front and rear corners of the main compartment 24. There are thus 4 total handles on the lateral and upper sides of the backpack 22.

Figure 8:
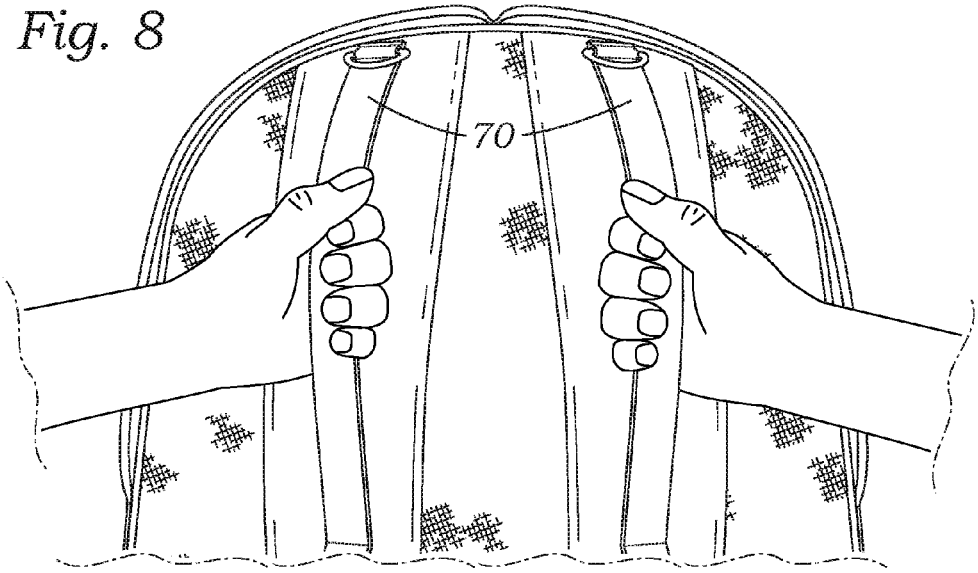
Figure 9:
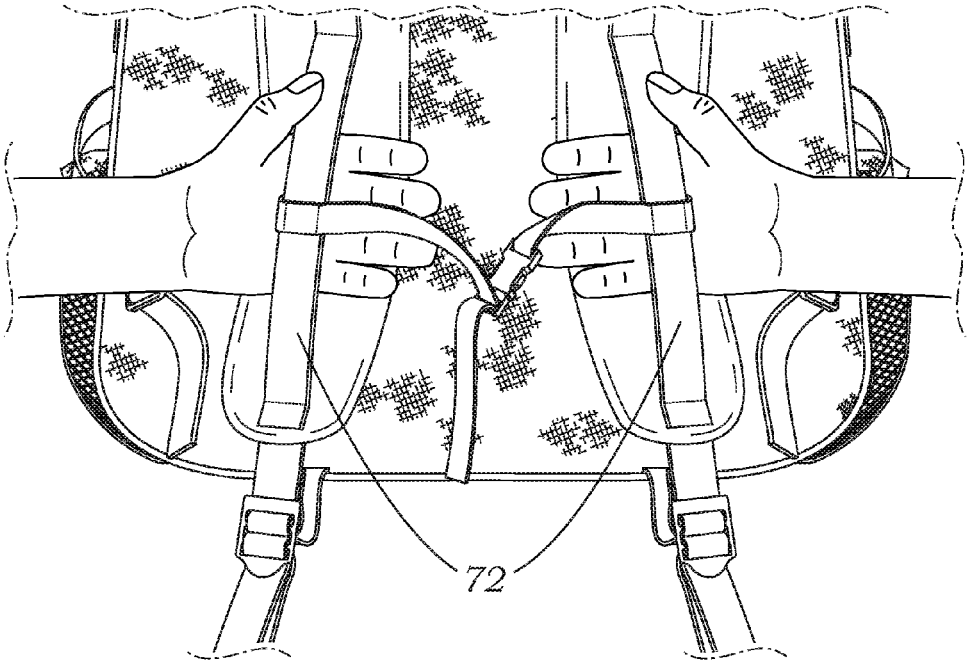
FIGS. 9 and 10 are partial front perspective views showing how a caregiver grasps several lower front handles.

With reference again to FIG. 2, a number of handles that are provided on the front side of the backpack 20 will be described. First of all, each of the shoulder straps 30 is provided with two vertically-oriented handles 70, 72. Upper vertical handles 70 comprised strap material that is sewn at an upper front corner 31 of the main compartment 24, and again approximately midway down the corresponding shoulder strap 30. Lower vertical handles 72 comprised strap material that is sewn at the midpoint of each shoulder strap 30, and again near the lower end of the respective shoulder strap. Indeed, the upper and lower vertical handles 70, 72 may be formed by a single strap of material that is sewn at three places along the respective shoulder strap 30. FIGS. 4 and 8 how a caregiver grasps the upper vertical handles 70, while FIG. 9 illustrates a person grasping the lower vertical handles 72.

Figure 10:
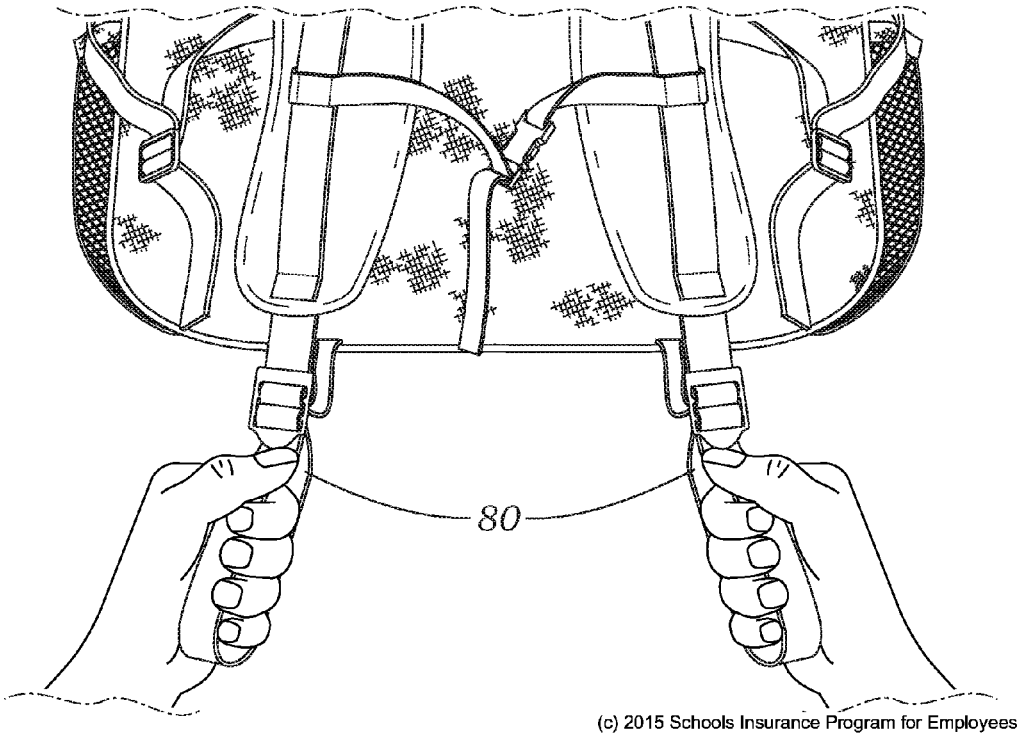

Each of the shoulder straps 30 desirably comprises a reinforced or padded portion 74 that terminates near a lower end of the backpack 20, and the adjustable strap 33 then connects the lower end of the padded portion 74 to the lower front corner 32 of the main panel 24. The ladder-lock buckle 34 is typically provided for adjustment of the length of the shoulder strap 30 so as to adjust for different sized users. A pair of lower front handles 80 attaches to the lower end of each of the shoulder straps 30. FIG. 10 shows a caregiver grasping both of the lower front handles 80. As mentioned, the handles 80 are fixed in dimension, preferably by sewing a loop in a length of strap material. The strap material then passes through the ladder-lock buckle 34 and extends to the lower front corner 32 and attaches thereto. The front of the backpack 20 thus has the upper and lower vertical handles 70, 72, and the lower front handles 80, for a total of 6 handles.

In a preferred embodiment of the backpack 20, the shoulder straps 30 are held together laterally by a central horizontal sternum strap 82. This type of strap 82 is fairly common, but it should be noted that it can also be used as a handle. In addition to the sternum strap 82, a pair of underarm security straps 84 extend from a midpoint of each of the shoulder straps 30 to a side panel of the backpack. The underarm security straps 84 are preferably adjustable in length, though they also may be used as handles in a pinch. The underarm straps are important because they help prevent the backpack from laterally sliding off the user when they stumble. In one embodiment, underarm handles 86 are provided on the underarm security straps 84, as seen in FIG. 2, such that the front of the backpack has 8 total handles.

Figure 12:
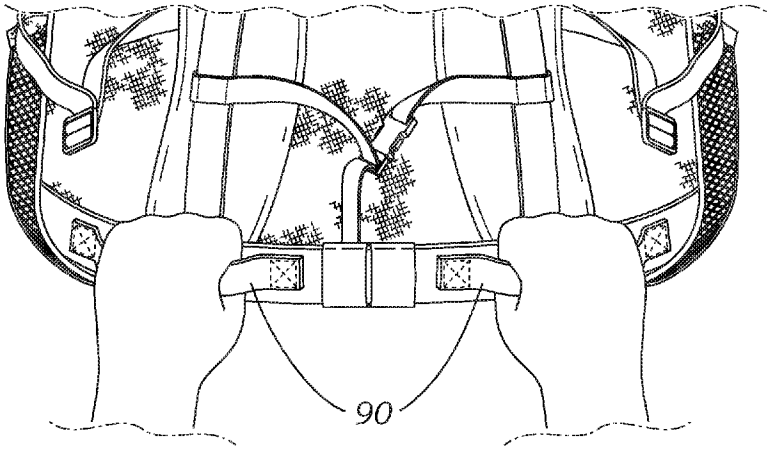
FIGS. 11 and 12 are front views of the stabilizing backpack showing two additional front lower handles attached to a waist belt, and how a caregiver might grasp the handles.
Figure 11:
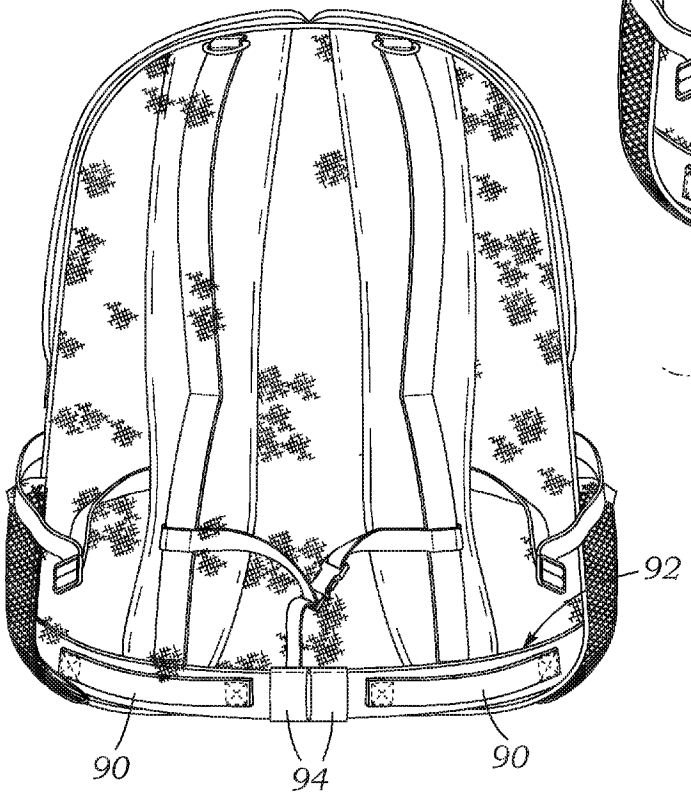

FIGS. 11 and 12 are front views of an alternative stabilizing backpack 20 showing two additional front lower handles 90 attached to a waist belt 92. Waist belts are common in some backpacks to provide additional abdominal or lumbar support, and typically include two relatively wide padded straps from each front side connected in the middle with a buckle 94 or the equivalent. FIG. 12 shows how a caregiver might grasp the handles 90, so as to stabilize a wearer of the backpack who loses his/her balance backwards. In the illustrated embodiment there is one handle 90 sewn to each strap of the waist belt 92. The lower front handles 80 and underarm security straps 84, as seen in FIG. 2, are omitted for clarity, but if they were present there would now be a total of 10 handles on the front of the backpack.

As mentioned above, the stabilizing backpack of the present application has at least 9 handles distributed around the front, back, top, and sides. That is, there are at least 2 large upper handles on either lateral side, at least 3 handles on the rear face of the backpack, and at least 4 handles on the front face of the backpack. However, with the addition of the other handle embodiments, for example the side handles 64 or the underarm security straps 84 there may be at least 11 of the fixed dimension handles. In one embodiment, with all of the straps mentioned, there are 16 of the fixed dimension handles.

Closing Comments

As used herein, "plurality" means two or more. As used herein, a "set" of items may include one or more of such items. As used herein, whether in the written description or the claims, the terms "comprising", "including", "carrying", "having", "containing", "involving", and the like are to be understood to be open-ended, i.e., to mean including but not limited to. Only the transitional phrases "consisting of" and "consisting essentially of", respectively, are closed or semi-closed transitional phrases with respect to claims. Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements. As used herein, "and/or" means that the listed items are alternatives, but the alternatives also include any combination of the listed items.

It is claimed:

1. A backpack, comprising:

a main compartment defining an inner cavity, and an opening thereto;

laterally spaced-apart shoulder straps on the front of the main compartment; and at least 9 fixed dimension handles distributed around the main compartment for use in stabilizing a wearer of the backpack, wherein each fixed dimension handle consists of a non-adjustable length of fabric material attached at opposite ends to the backpack to form a handle of fixed dimension of at least 4 inches in length adapted to receive the average palm of an adult for grasping, wherein at least four of the handles are on a front side of the main compartment and vertically oriented into pairs each attached to a front side of both shoulder straps.

2. The backpack of claim 1, further including adjustable underarm security straps connecting the shoulder straps to respective side panels.

3. The backpack of claim 2, wherein there are six handles on a front side of the main compartment.

4. The backpack of claim 3, wherein of six handles on the front side of the main compartment, two straps extend downward from the bottom of the shoulder straps.

5. The backpack of claim 1, wherein at least three of the handles are on a rear side of the main compartment.

6. The backpack of claim 5, wherein the three handles include a vertically oriented central handle attached to a front panel of the main compartment, and two laterally spaced apart lower handles.

7. The backpack of claim 1, wherein at least two of the handles are on a side panel of the main compartment.

8. The backpack of claim 1, wherein there are at least 11 of the fixed dimension handles.

9. The backpack of claim 1, wherein there are 16 of the fixed dimension handles.

10. The backpack of claim 1, further including an adjustable length lead having a lead handle secured to a rear side of the main compartment.

11. A backpack, comprising:

a main compartment defining an inner cavity, and an opening thereto;

laterally spaced-apart shoulder straps on the front of the main compartment;

at least 3 fixed dimension handles provided on a rear side of the main compartment;

at least 4 fixed dimension handles provided on a front side of the main compartment; and 2 fixed dimension handles provided on a side panel of the main compartment, the upper ends of which are secured to a top of the main compartment, wherein each fixed dimension handle consists of a non-adjustable length of fabric material attached at opposite ends to the backpack to form a handle of fixed dimension of at least 4 inches in length adapted to receive the average palm of an adult for grasping.

12. The backpack of claim 11, wherein the four handles on the front side are vertically oriented into pairs each attached to a front side of both shoulder straps.

13. The backpack of claim 12, wherein there are six handles on the front side of the main compartment, with two straps extending downward from the bottom of the shoulder straps.

14. The backpack of claim 11, wherein the 3 handles on the rear side include a vertically oriented central handle attached to a front panel of the main compartment, and two laterally spaced apart lower handles.

15. The backpack of claim 14, further including a horizontal handle attached between the two lower handles.

16. The backpack of claim 11, wherein there are 4 handles on the side panel, wherein two vertical handles and two horizontal handles attach to the side panel at a midpoint thereof.

17. The backpack of claim 11, wherein there are at least 11 of the fixed dimension handles.

18. The backpack of claim 11, wherein there are 16 of the fixed dimension handles.

19. The backpack of claim 11, further including an adjustable length lead having a lead handle secured to a D-ring on the rear side of the main compartment.

20. The backpack of claim 11, further including adjustable underarm security straps connecting the shoulder straps to respective side panels.

* * * * *